United States Patent [19]

Koncelik

[11] 4,332,042

[45] Jun. 1, 1982

[54] GERIATRIC ENVIRONMENTAL SYSTEMING

[75] Inventor: Joseph A. Koncelik, Worthington, Ohio

[73] Assignee: Burlington Industries, Inc., Greensboro, N.C.

[21] Appl. No.: 136,095

[22] Filed: Mar. 31, 1980

[51] Int. Cl.[3] ..... A47C 19/22; A61G 7/00; A47C 21/00

[52] U.S. Cl. ..... 5/424; 5/53 R; 5/60; 5/285; 5/503; 5/508; 5/512; 362/130

[58] Field of Search ..... 5/60, 503, 508, 474, 5/440, 424, 53 R, 285, 427, 445, 425, 491, 512; 362/130

[56] References Cited

U.S. PATENT DOCUMENTS

| | | | |
|---|---|---|---|
| 164,640 | 6/1875 | Coburn | 160/126 |
| 217,682 | 7/1879 | Dewing | 312/258 |
| D. 253,246 | 10/1979 | O'Toole | D24/1.1 |
| 835,701 | 11/1906 | Burford | 312/271 |
| 893,694 | 7/1908 | Allenson | 312/243 |
| 1,806,773 | 5/1931 | Waters | 362/235 |
| 1,991,111 | 2/1935 | Murrell | 5/508 |
| 2,093,164 | 9/1937 | De Boer | 5/131 |
| 2,375,941 | 5/1945 | Nostrand | 5/512 |
| 2,428,649 | 10/1947 | Brown | 5/508 |
| 2,679,283 | 5/1954 | Mahone | 5/507 |
| 3,048,461 | 7/1962 | Peterson | 312/309 |
| 3,062,602 | 11/1962 | O'Brien et al. | 5/507 |
| 3,125,769 | 3/1964 | Black et al. | 5/430 |
| 3,258,791 | 7/1966 | Kaplan | 5/499 |
| 3,378,860 | 4/1968 | Frazier | 5/491 |
| 3,430,274 | 3/1969 | Ikeda et al. | 5/181 |
| 3,840,924 | 10/1974 | Hamilton | 5/503 |
| 3,899,228 | 8/1975 | Schreiber | 312/107 |
| 4,081,870 | 4/1978 | Iannucci | 5/491 |
| 4,104,710 | 8/1978 | Damico et al. | 362/130 |
| 4,181,990 | 1/1980 | Santo | 5/474 |
| 4,286,344 | 9/1981 | Ikeda | 5/474 |

FOREIGN PATENT DOCUMENTS

| | | | |
|---|---|---|---|
| 126305 | 8/1931 | Austria | 5/503 |
| 6839 | 9/1980 | European Pat. Off. . | |
| 1943815 | 3/1970 | Fed. Rep. of Germany . | |
| 1766850 | 9/1971 | Fed. Rep. of Germany . | |
| 2336905 | 2/1975 | Fed. Rep. of Germany . | |
| 2652998 | 5/1978 | Fed. Rep. of Germany . | |
| 2731806 | 1/1979 | Fed. Rep. of Germany . | |
| 37433 | 12/1967 | Finland . | |
| 1575451 | 6/1969 | France . | |
| 2111555 | 2/1972 | France . | |
| 614367 | 11/1979 | Switzerland | 5/425 |
| 666829 | 2/1952 | United Kingdom | 5/503 |

OTHER PUBLICATIONS

"Action Office by Herman Miller"–Brochure by Herman Miller, Inc., 1977, Zeeland, Michigan, 49464.

"Designing the Open Nursing Home", a book by Joseph A. Koncelik, 1976, Dowden, Hutchinson & Ross, Inc.

*Primary Examiner*—Alexander Grosz

*Attorney, Agent, or Firm*—Cushman, Darby & Cushman

[57] ABSTRACT

An arrangement and method for defining personalized environments for nursing homes are provided, which supply safety, comfort, control, and sense of personal ownership for aging people occupying the nursing home. A plurality of wall panels distinct from the nursing home permanent walls define a room environment, and utilize a bed assembly as the focal point with a plurality of miscellaneous clothing and article supporting and enclosing structures. The bed is integrated with the wall panels and miscellaneous structures so that the bed does not detract from the functioning of the structures, and all miscellaneous structures are supported on the wall panel so that they are spaced from the ground at least a distance sufficient to provide clearance for the toeboards of wheelchairs. The corners of all miscellaneous structures and the bed assembly are rounded, and sufficient clearance is provided between the bed assembly and any miscellaneous structures along both sides and the foot of the bed assembly. Bolsters rigid enough to sit on and facilitate wheelchair to bed transfers are provided along either side of the bed; the bolsters also function to cover all bed hardware and other sharp or hard components associated with the bed assembly and cushion the impact of any fall by an elderly person. A headboard panel is provided having a linear light source extending substantially the width of the bed.

15 Claims, 25 Drawing Figures

Fig. 6
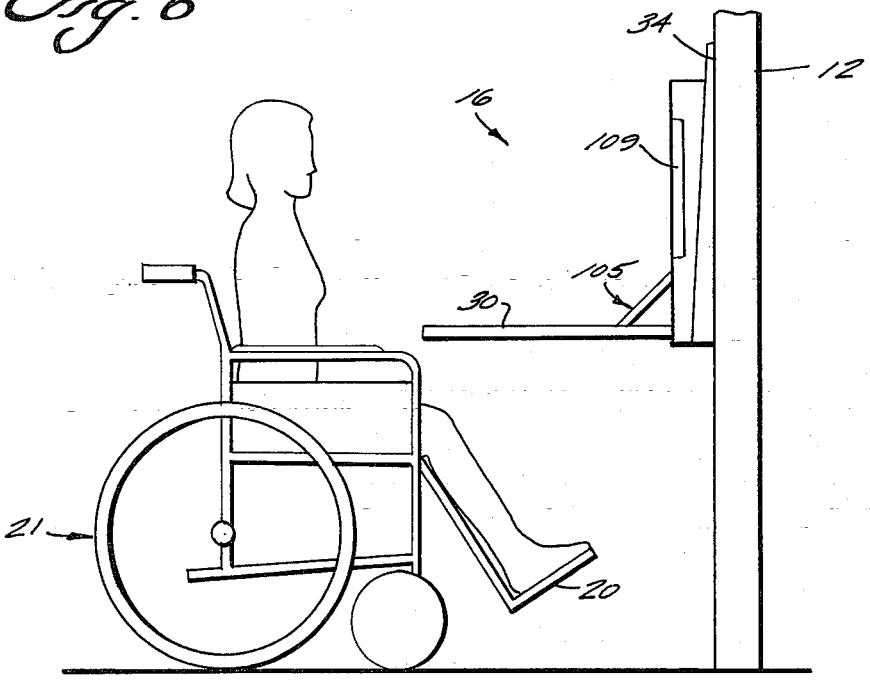
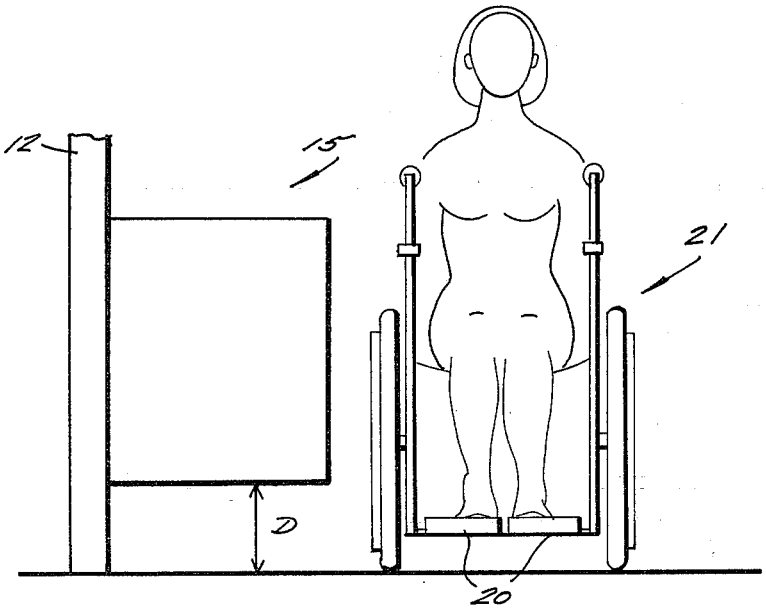
Fig. 5

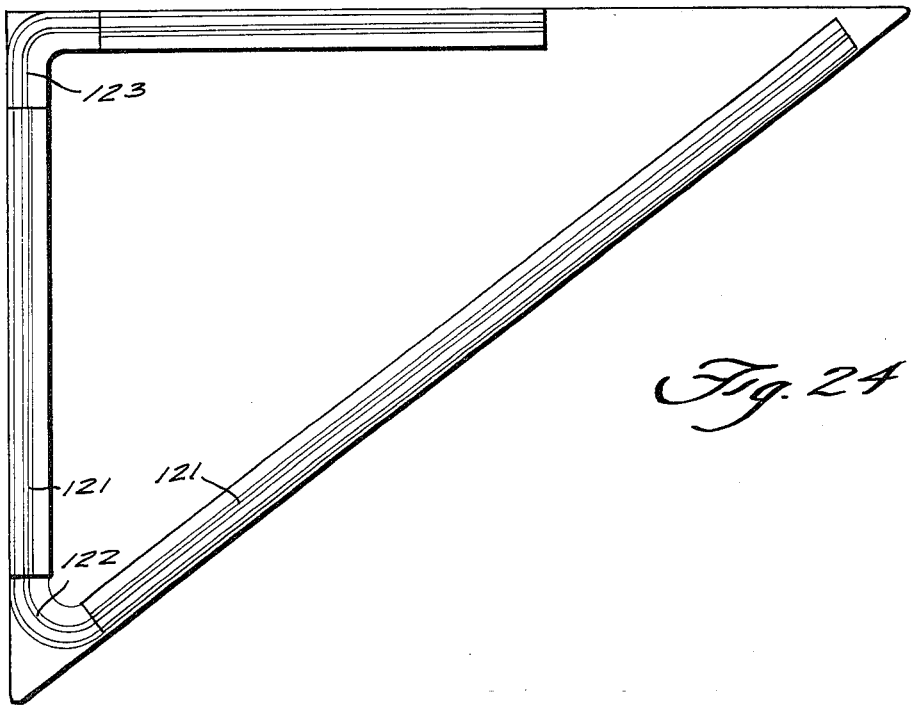
Fig. 24
Fig. 25
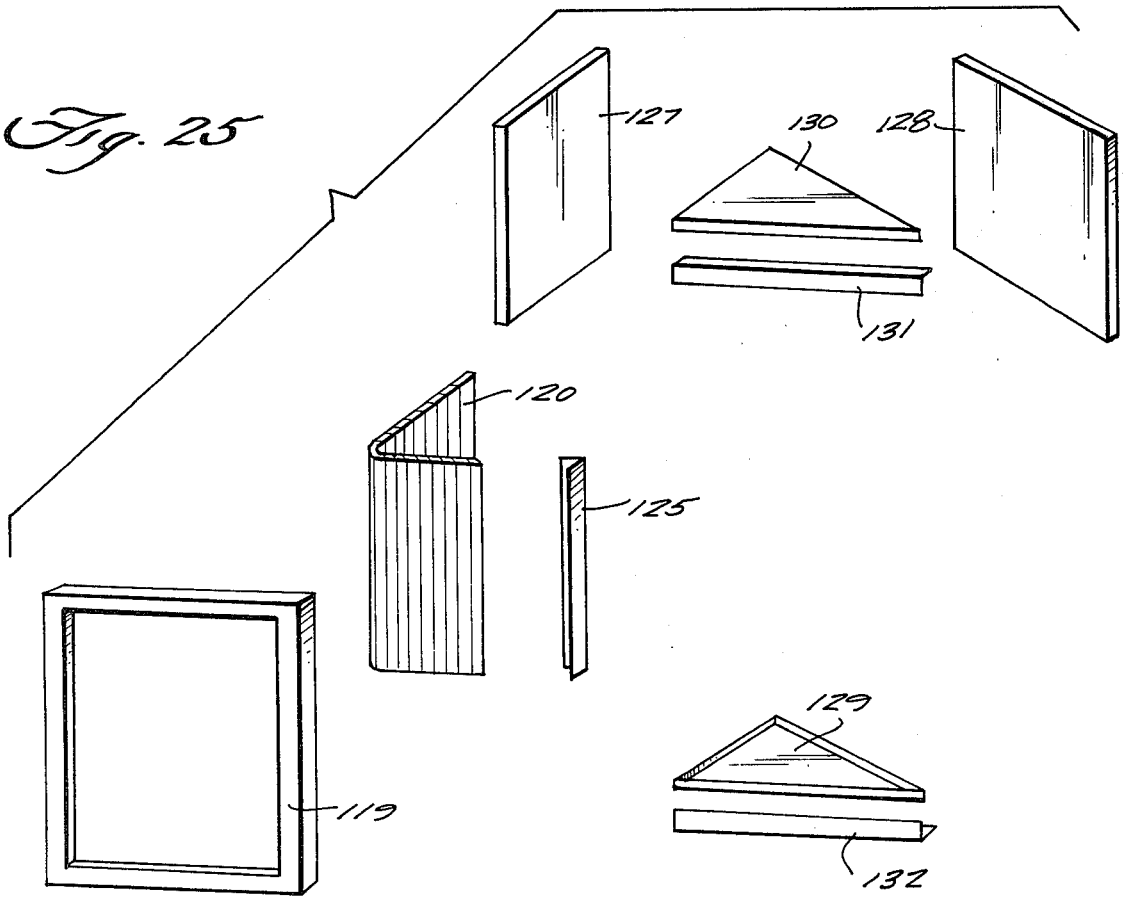

GERIATRIC ENVIRONMENTAL SYSTEMING

BACKGROUND AND SUMMARY OF THE INVENTION

Long term care facilities for the aged, commonly referred to as nursing homes, have developed a position of prominence in the care of the aged in modern societies. The nursing home environment is completely different from a hospital environment; this uniqueness of the nursing home environment has been discussed in "Designing The Open Nursing Home" by Joseph A. Koncelik; Dowden, Hutchinson and Ross, Inc. of Stoudsburg, Pennsylvania, 1976. Because of this uniqueness, it has been determined that the type of care given to an aged person in a nursing home—as well as the duration of that care—should be reflected in the physical environment where that care is provided. There are special requirements for architecture, interiors, furnishings, and products that cannot be met by diluting the hospital environment concept.

While the understanding of the importance of environment has increased, remaining yet unchallenged and unsolved in the prior art is the problem of appropriate designing of furnishings, products, etcetera making up the personal space in room settings where aged people spend the majority of their time.

Aging is a gradual—even imperceptible—process, and all aging people adapt to the changes the aging process brings about. With aging, gradual adaptation allows a lingering question to persist regarding one's limitations and capabilities so that as people grow older they find themselves constantly readjusting and challenging their own self concept. While many aging individuals find themselves overextended in high stress situations, an aged individual living in a nursing home may find himself or herself underextended—that is not sufficiently challenged, stimulated, or encouraged to perform. An acceleration of the aging process may thus actually occur as a result of an environment which does not sufficiently challenge, stimulate, or enncourage. Thus, a nuring home environment must be provided so that it is supportive, but not so supportive that necessary challenge is reduced. The environment must also reflect the individual aged person's own personal control over the physical products within it.

In order to provide stimulation, a sense of control, and challenge within the close environment of a nursing home the following criteria should be taken into account: Safety problems and hazards should be ameliorated. Sufficient space should be provided around furnishings and other objects in the personal space environment to provide accessability to both the ambulatory and nonambulatory users. The personal space should promote—not impede—independently initiated transfers of the elderly resident from surface to surface, surface to wheelchair, etcetera. All routine functions of self care and maintenance should be independently initiated and supported by the structures within the personal space. Room arrangements should allow for the exercise of personal preference in furnishings on the part of the resident. A sense of personal ownership should prevail over the room space and the objects within it. The personal space must support a wide range of activities—especially movement around the space—without impeding accessability and with sufficient physical security to promote use of space without a sense of fear. Sound and light must be carefully managed and modulated to allow for maximum accuracy of discrimination of objects and communications by the aged resident, as well as appropriate background levels.

According to the present invention a method of providing interior space room divisions for a nursing home, and furnishings utilized in nursing home design, have been provided which take into account all the criteria discussed above to provide a nursing home environment providing maximized physical and psychological desirability for aged residents of the nursing home. The environment provides safety, comfort, control, and a sense of personal ownership for the aged residents, and accomplishes this in a manner that makes construction and renovation of nursing homes much less time consuming and costly.

According to one aspect of the present invention, a method for providing interior space room divisions for a nursing home is supplied for providing safety, comfort, control, and sense of personal ownership for aging people to be occupying the nursing home. The method utilizes a bed assembly, a plurality of wall panels (distinct from the permanent walls of the nursing home), and a plurality of miscellaneous clothing and article supporting and enclosing structures (such as dressers, desks, personalized bulletin boards, and closet units).

In practicing the method, the wall panels are attached together to provide at least a portion of the physical definition of the room environment. The bed is integrated with the wall panels and the miscellaneous structures so that the bed does not detract from the functioning of the miscellaneous structures. The miscellaneous structures (such as dressers, desks, closets, etcetera) are supported on the wall panels so that they are spaced from the ground at least a distance sufficient to provide clearance for the toeboards of wheelchairs to provide maximum mobility for nonambulatory, as well as ambulatory, residents or guests. The corners of all the miscellaneous structures and the bed assembly are rounded, and sufficient clearance is provided for a wheelchair between the bed assembly and any miscellaneous structures along both sides and the foot of the bed assembly. Wiring for electrically consuming components disposed within the room environment is passed through the wall panels to an electrical outlet remote from the room environment so that no wiring extends on the floor of the room environment. Preferably, one of the wall panels comprises a headboard-wall panel disposed at the head of the bed assembly, and spaced from the nursing home permanent walls (both the exterior and, —if they exist—interior), and a linear light source is attached to the headboard panel mounted above the bed assembly so that light shines on at least areas of the bed assembly adjacent the headboard-wall panel across substantially the entire width thereof. All bed hardware, and other sharp or hard components associated with the bed assembly, are covered with cushioning structures operatively attached to the bed assembly so that an aging person falling so as to impact the side of the bed assembly will have their fall cushioned so as to minimize the chances of injury.

A pair of bolsters elongated in parallel directions of elongation preferably are provided, one disposed on either side of the bed mattress. Each bolster is formed of material sufficiently rigid so that a person may sit thereon without significantly deforming it, yet it is soft enough to cushion the fall of an individual thereon so as to minimize injury. The bolsters are mounted with respect to the mattress so that a top surface of each of the bolsters may be substantially even with the top of the mattress. Such height also is chosen so as to correspond to the height of a seat of a wheelchair.

One of the miscellaneous structures preferably comprises a dresser having at least two side-by-side drawers. The dresser is positioned, mounted on a wall panel, so that a person in a wheelchair can approach the dresser head-on, but toward one side thereof, and open the side-by-side drawer on the opposite side as the wheelchair without having to move the wheelchair backwards.

A rail support is provided along at least one side of the bed assembly. The rail support, which is preferably mounted on the bolsters, assists transfer from a wheelchair to the bed assembly while not preventing access to the bed assembly. The rail may be collapsed completely out of the way if desired.

Further miscellaneous structures provided for mounting on wall panels include a fold-down desk and a unit for storing clothing or other articles. A personalized bulletin board, mirror, and like articles also are adapted to be supported by the panels, and at least one of the panels preferably has a light source located at the top thereof for directing light upwardly therefrom to provide indirect, background illumination. A tray is provided that may be supported by the bed assembly rails, or may be stored in a convenient location covering the bed toeboard.

It is the primary object of the present invention to provide room divisions for a nursing home and furnishings integrated therewith for providing safety, comfort, control, and sense of personal ownership for aging people to be occupying the nursing home. This and other objects of the invention will become clear from an inspection of the detailed description of the invention, and from the appended claims.

BRIEF DESCRIPTION OF THE DRAWINGS

FIGS. 4 and 5 are top plan and side views, respectively, illustrating a nonambulatory individual in position adjacent a dresser like that illustrated in FIG. 1;

FIG. 6 is a side view illustrating a nonambulatory individual utilizing a desk such as illustrated in FIG. 1;

FIG. 24 is a top plan view of the bottom constructional component of the closet unit illustrated in FIG. 22; and FIG. 25 is an exploded perspective view of major components of the closet unit illustrated in FIG. 22.

DETAILED DESCRIPTION OF THE DRAWINGS

Figure 1:
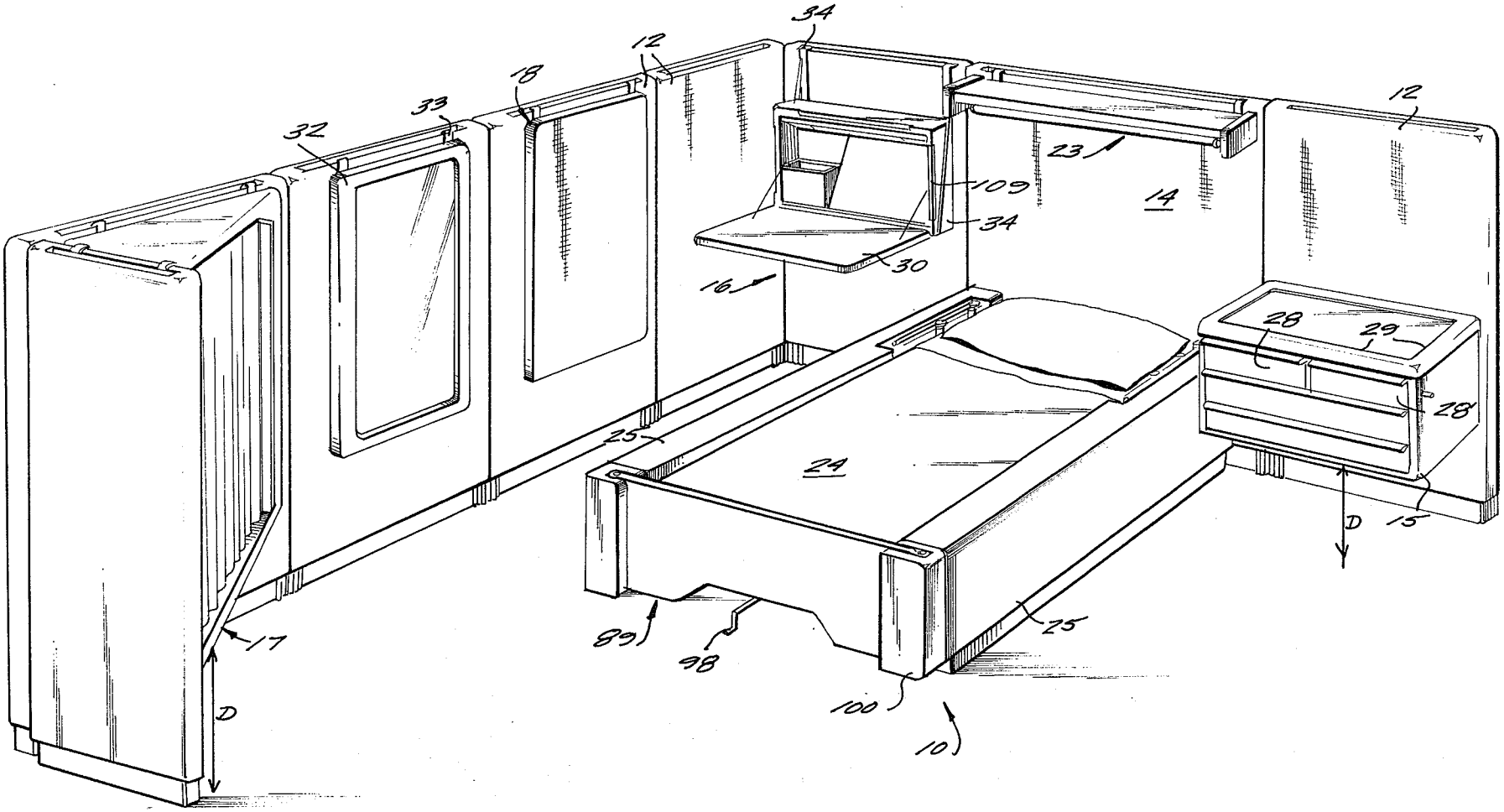
FIG. 1 is a perspective view of a personalized environmental setting for a nursing home utilizing the teachings of the present invention.

An exemplary interior space division for practicing an exemplary method according to the present invention is illustrated in FIG. 1. The arrangement is provided for a nursing home having permanent walls, for providing safety, comfort, control, and sense of personal ownership for aging people to be occupying the nursing home. The room components primarily comprise a bed assembly, illustrated generally at 10, a plurality of wall panels 12, 14, and a plurality of miscellaneous clothing and article supporting and enclosing structures such as dresser 15, fold-down desk assembly 16, closet 17, and personalized bulletin board 18.

The wall panels 12 are comparable to conventional upholstered panels for dividing work areas and office space, such as those sold by J. G. Furniture, a Division of Burlington Industries, of Quakertown, Pennsylvania, under the name "UPS". Conventional panel joining hardware is utilized to attach the panels 12, 14 together, and they are connected together to provide at least a portion of the physical definition of the room environment. For instance, the division provided in FIG. 1 may be utilized in conjunction with an exterior permanent wall of a building having a window, or other panels 12 may be hooked up to those illustrated to completely define a room environment. The bed assembly 10 is integrated with the wall panels 12 and miscellaneous structures 15, 16 etcetera so that the bed does not detract from the functioning of the miscellaneous structures. That is, access to the dresser 15, desk 16, closet unit 17, etcetera is unimpeded by the bed, it not being necessary to maneuver around structures in order to have access to all accessory components.

Figure 2:
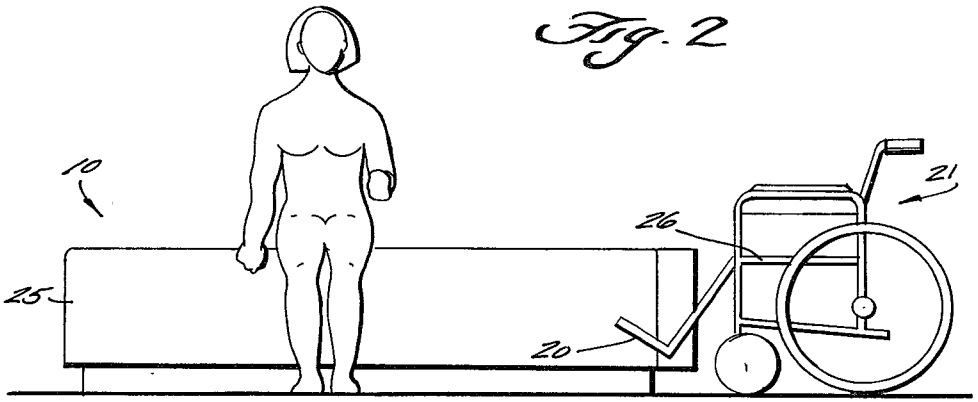
FIGS. 2 and 3 are side and top plan views, respectively, illustrating mechanisms of transfer of a nonambulatory individual to the bed assembly of FIG. 1.

The miscellaneous structures 15, 16 etcetera are supported on the wall panels 12 so that they are spaced from the ground at least a distance D sufficient to provide clearance for the toeboards 20 (see FIGS. 2 and 6) of wheelchairs 21. All corners of all of the miscellaneous structures and the bed assembly are rounded, as illustrated in all of the drawing figures. Further, sufficient clearance is provided for a wheelchair 21 between the bed assembly 10 and any miscellaneous structures along both sides and the foot of the bed.

The panel 14 comprises a headboard-wall panel disposed at the head of the bed assembly 10, and spaced from the nursing home permanent walls. A linear light source 23 (e.g. a fluorescent light) is releasably attached to the headboard-wall panel 14, as by hanging it thereto in the same manner that the fold-down desk 16, bulletin board 18, etcetera are attached to wall panels 12. The light source 23 shines light on at least areas of the bed assembly 10 adjacent the panel 14, across substantially the width thereof.

The bed assembly 10 includes a mattress 24 and a pair of elongated bolsters 25, one disposed on either side of the mattress 24. The mattress 24 is supported by a conventional mattress frame, the bolsters 25 being independent thereof.

Figure 3:
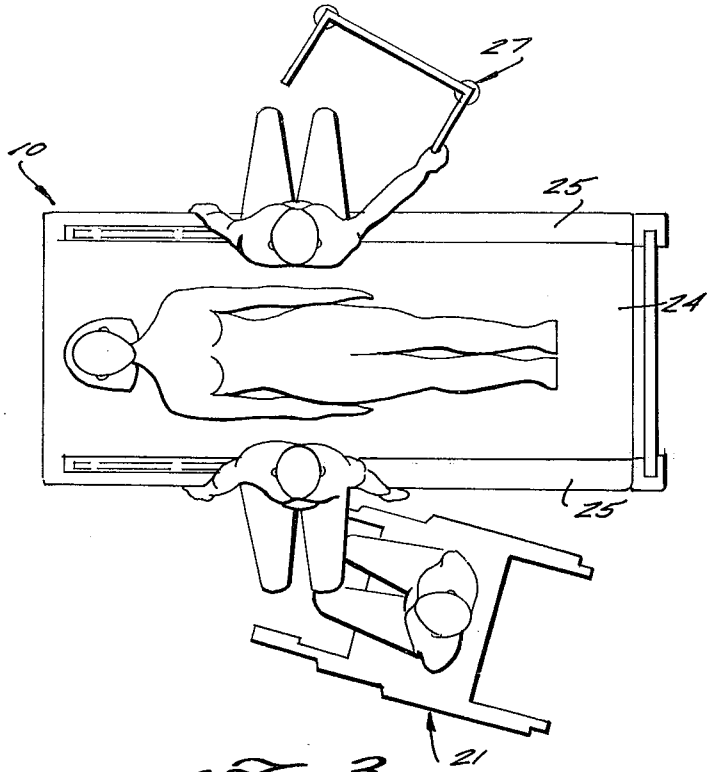
Figure 10:
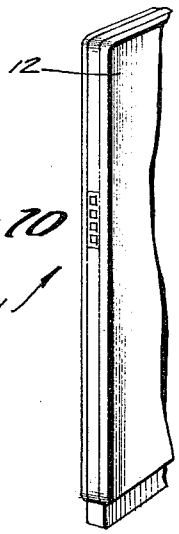
FIG. 10 is a perspective detail view of a control console provided in an end wall panel.
Figure 9:
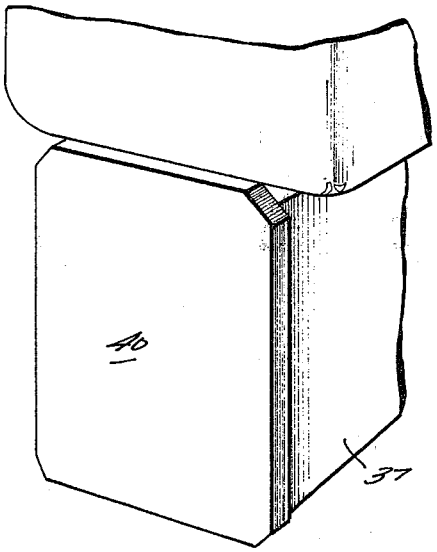
FIGS. 8 and 9 are alternative bottom terminations of wall panels such as illustrated in FIG. 7.
Figure 8:
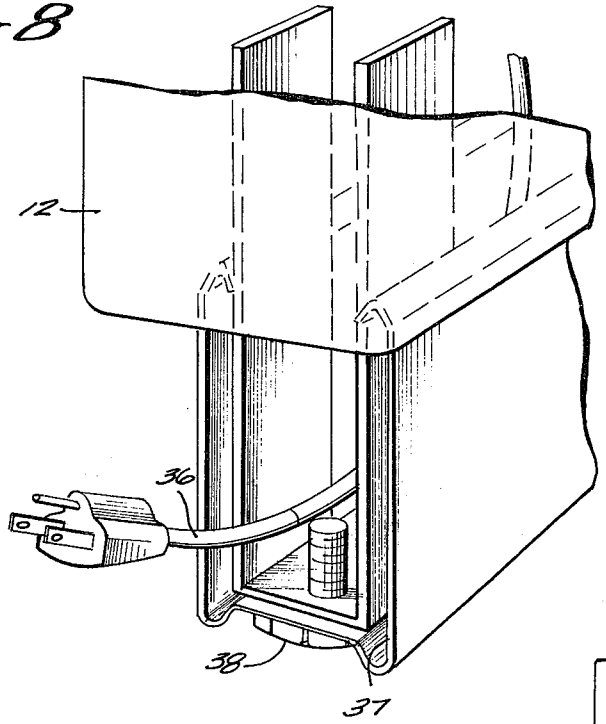
Figure 7:
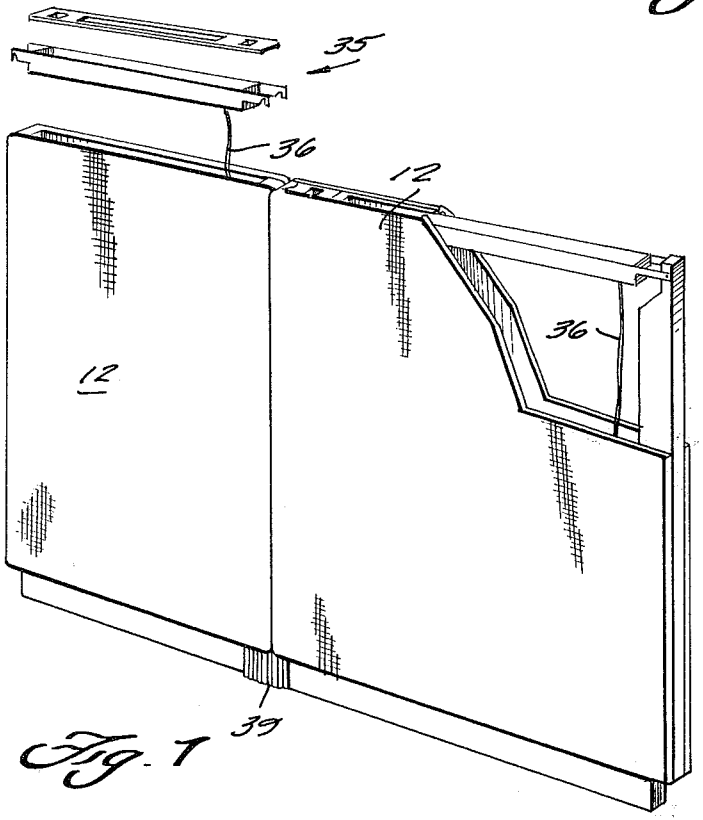
FIG. 7 is a perspective view, with portions cut-away or exploded for clairty, of exemplary wall panels that may be utilized in practicing the present invention.

The arrangement illustrated in the drawings provides for proper transfer conditions to and from the bed assembly 10 for nonambulatory residents. As illustrated most clearly in FIG. 2, the height of the bed assembly 10 is substantially equal to the height of a seat 26 of a wheelchair 21. For instance the height of the bolsters 25 (even with the top of the mattress 24) may be 20 inches, the conventional height of a wheelchair seat 26 being 19.5 inches. The bed assembly 10 is designed and positioned so that no structural, bed rail devices, or excessory obstacles impede transfer to the bed assembly 10 from a wheelchair 21 or walker 27. In this regard attention is particularly directed to FIG. 3 illustrating exemplary transfer conditions. For instance, an individual in wheelchair 21 positions the wheelchair at about 15° to the direction of elongation of bolster 25, sufficient clearance being provided adjacent the site of the bed assembly to so position the wheelchair 21. Then the individual rotates about his/her center of gravity to a position sitting on the side of the bed assembly 10 (i.e. bolster 25). The patient may then further rotate about his/her center of gravity to assume a completely prone position on the bed. A similar approach is taken when the individual utilizes a walker 27, as also schematically illustrated in FIG. 3. Preferably, 36 inches will be provided on either side of the bed assembly 10 for ideal transfer conditions of nonambulatory residents from a wheelchair to the bed assembly 10, with a minimum distance of 26 inches being provided for ambulatory egress for users of canes, crutches, or a walker 27.

Figure 4:
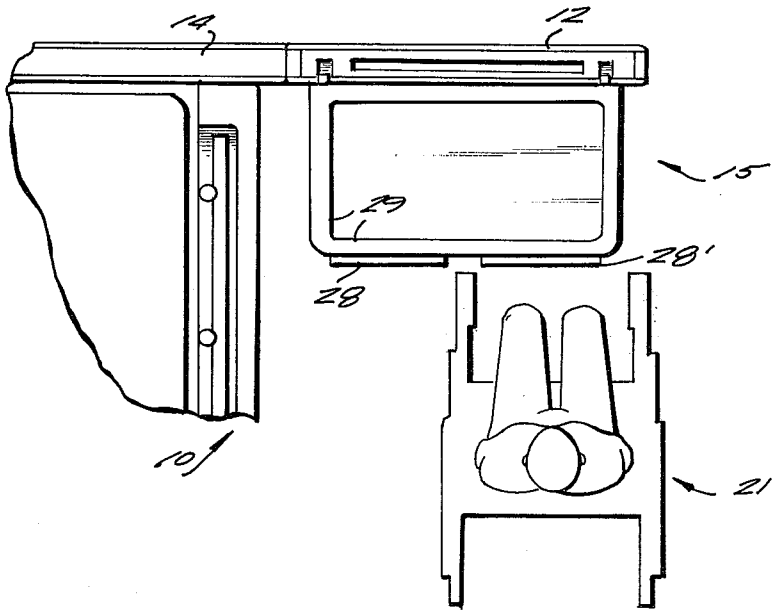

As illustrated most clearly in FIGS. 1, 4 and 5, the dresser 15 is constructed having at least two side-by-side drawers 28, 28'. The dresser 15 is so positioned that a person in a wheelchair 21 (see FIG. 4) can approach the dresser headon, but toward one side thereof, and open the side-by-side drawer (28 in FIG. 4) on the opposite as the wheelchair without having to move the wheelchair backwards. The toeboard clearance D is most clearly illustrated in FIG. 5, and preferably will be a minimum of about 8 inches, while the depth of the dresser 15 preferably will be about 21 inches. Preferably one of the dresser drawers (e.g. drawer 28') is lockable for the storage of valuable personal belongings. Low friction drawer glides are provided to allow the drawers to be easily pulled open (palm down) to aid residents with arthritic complications, and the top surface of the desk 16 is recessed—as indicated at 29 in FIGS. 1 and 4—to prevent small objects from rolling off.

FIG. 6 illustrates the positioning of a writing surface 30 of fold-down desk 16 (or comparable work surface) in relationship to a wheelchair 21, providing the proper relative height and depth thereof. For instance the depth of the writing surface 30 may be about 24 inches, and may be located 31 inches off the ground.

A nursing home utilizing the features according to the present invention may be a conventional nursing home with permanent interior and exterior walls, the panels 12, etcetera subdividing rooms defined by interior permanent walls and/or redefining room interiors. Additionally, however, the present invention allows the construction of nursing homes without any permanent interior walls, essentially all interior walls (at least in nursing spaces) being provided by the wall panels 12, 14 etcetera.

Panel System

As previously mentioned, the panels 12 are comparable to conventional panels for subdividing work areas, such as the J. G. Furniture UPS panels. The panels 12 may be upholstered, or they may be vinyl covered for easy cleaning and may be treated chemically to eliminate bacterial odors. The panels will be of sufficient height to conveniently support all of the excessory structures (e.g. bulletin board 18, a mirror 32—see FIG. 1—, etcetera), and preferably have a height greater than about 5 feet (e.g. 62 inches). The panels may be provided in a variety of widths to accommodate normal spacing requirements. For instance, the panels on either side of the bed assembly 10 may have a width of 36 inches, corresponding to the desired spacing to accommodate nonambulatory residents for transferring to and from the bed assembly 10. The panels can be easily interchanged to allow for a variety of room configurations, and the accessory structures are conveniently hung to the panels utilizing conventional hangers (e.g. see hangers 33, 34 in FIG. 1). Of the components illustrated in the drawings, preferably only the dresser 15 is not hung from the wall panels with hangers 33, 34. The dresser 15 is rather securely structurally attached to a panel 12, and preferably is designed to support a weight up to 250 pounds.

The construction of various components of the panels 12 is illustrated most clearly in FIGS. 7 through 10. At least some of the panels preferably utilize drop-in fluorescent luminaires 35 in the top thereof, light shining upwardly from the tops of the panels to provide indirect lighting. Wiring for the luminaires 35, over bed light 23, and all other electrical consuming components disposed within the room environment is passed through the wall panels 12 to an electrical outlet remote from the room environment so that no wiring extends on the floor of the room environment, which wiring would present a safety hazard. Since the panels are hollow this is easily accomplished by passing the wires (e.g. wire 36 in FIGS. 7 and 8) downwardly through panels 12 through the extruded raceway 37 located at the base of each panel 12. Note that screw threaded leveling feet 38 also may be provided associated with each panel base 37 for properly leveling the panel 12. The bases of the panels butt join for both in-line and corner setup, with bridging components 39 being provided where desirable. The raceways 37 of end panels are provided with end caps 40 (see FIG. 9 in particular). Additionally, it is desirable to provide an end panel with a room switch accessory panel as a permanent installation in the panel. Such a switch panel is illustrated generally at 41 in FIG. 10, utilizing alternate action push button switches, with each switch color coded or having other indicia associated therewith indicating which room appliances are controlled thereby, and preferably being lighted.

Figure 12:
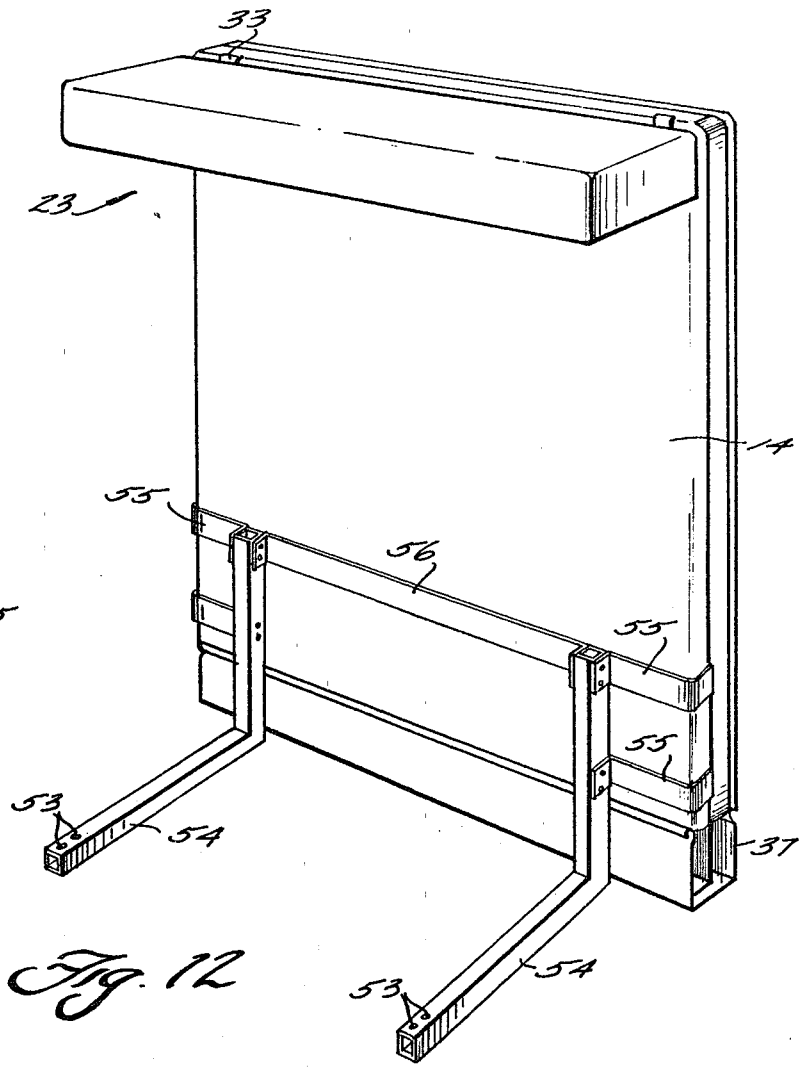
FIG. 12 is a perspective view of an exemplary headboard-wall panel utilized according to the invention.

The headboard-wall panel 14 is of basically the same construction as the other panels 12, and preferably is about 48 inches wide and will accept the over bed linear lighting unit 23 (see FIG. 12). The headboard panel 14 preferably is not tied into existing architecture in the nursing home, remaining distinct from the nursing home permanent walls. If desired, the headboard panel may be tied into the bed assembly 10, however.

The Bed Assembly

The bed assembly 10 provides the focal point for the room environment. A key feature thereof is the provision of the bolsters 25 alongside of the mattress 24. Each of the bolsters 25 is formed of material having sufficient hardness or rigidity so that a person may sit thereon without significantly deforming the same (see FIGS. 2 and 3), the bolsters 25 providing more support than an edge of mattress 24. This facilitates the transfer to and from the bed, and facilitates visiting by ambulatory individuals and care by doctors, nurses, etcetera, whom may utilize the bolsters 25 as seats. The height of the bolsters is generally comparable to the height of a seat 26 of a wheelchair 21, and the length thereof is substantially the same as the length of the mattress 24, with a width substantially less than the length or height but sufficient to facilitate bed egress and ingress.

While being hard enough to allow a person to sit thereon without significantly deforming the same, the bolsters also are soft enough so that a person falling so as to impact the side of the bed will impact the bolster and will have their fall cushioned by the bolster 25 so as to minimize the chances of injury. The bolsters 25 thus provide for covering of all bed hardware, and other sharp or hard components associated with the bed assembly. This is important since many injuries in nursing homes are caused by residents falling and impacting bed hardware.

Figure 11:
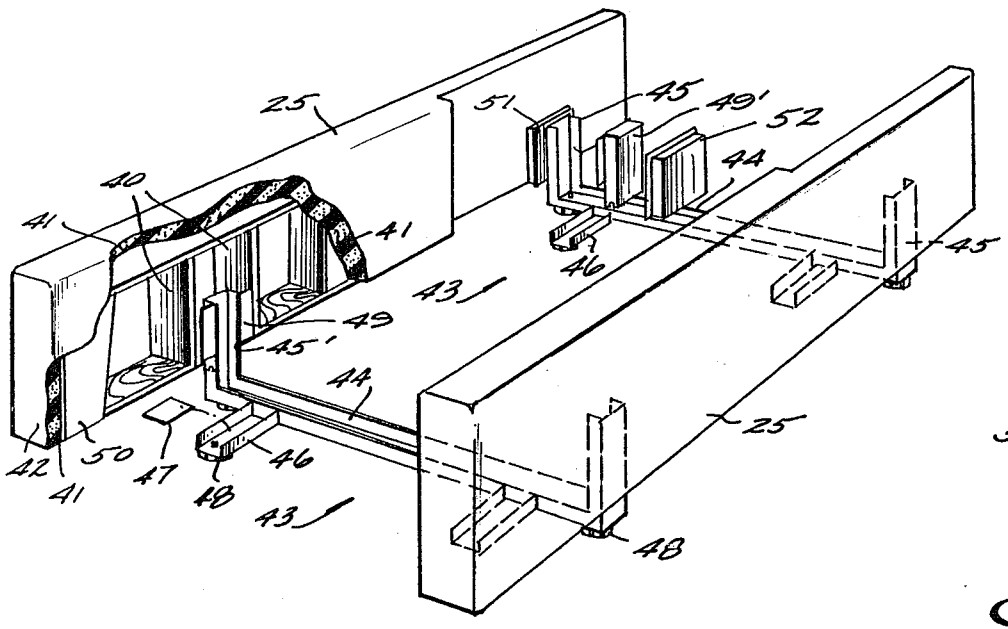
FIG. 11 is a perspective view, with portions cut-away for clarity, of an exemplary set of bolsters utilized according to the teachings of the present invention.

An exemplary interior construction of bolster 25 is illustrated in FIG. 11. The bolster 25 may comprise a frame 40 of relatively rigid material (e.g. wood) with a covering of relatively softer material, such as foam 41 covered with sheet material 42 (e.g. vinyl). An exemplary foam 41 that is suitable for providing the bolsters 25 with their desired characteristics is sold under the name RICHLUX T 111, manufactured by E. R. Carpenter Company, and having a minimum density of about 6 pounds per cubic foot, and a minimum resiliency of about 35%. Other generally comparable foams are of course also suitable.

Means are provided for mounting the bolsters with respect to the mattress 24 so that the top surface of each may be substantially even (although the bed mattress 24 may be adjustable upwardly and downwardly; the top of the bolster 25 provides a reference height, however), and so that a person impacting the bed assembly along the sides thereof will impact the bolster 25. The bolster mounting means may comprise an undercarriage support structure, illustrated generally at 43 in FIG. 11, for receiving the legs of a conventional mattress supporting frame and preventing substantial movement thereof with respect to the bolsters 25. The undercarriage support structure may include a pair of horizontal channel-shaped metal members 44 extending perpendicular to the direction of elongation of the bolsters 25, and each having a pair of end portions 45 extending vertically. The vertical end portions 45 also are preferably channel-shaped. The members 44 are positioned relative to the bolsters 25 in positions convenient for proper support thereof, and where necessary or desirable channel-shaped extensions 46 from the members 44 are provided to actually receive the legs of the bed supporting frame. A pad 47 may be provided in each structure 46 at a point at which the mattress frame leg will actually be touching the extension 46. The members 44, 46 also are provided with leveling leg portions 48, screw threaded into the members 44, 46 and adjustable to properly position the undercarriage 43 on uneven floor surfaces, being comparable to the leveling feet 38 of the panels 12.

Structures are associated with the bolsters 25 for receipt of the end portions 45 of members 44. While the bolsters 25 and end portions 45 may be rigidly attached, preferably the bolsters 25 merely slide over the vertical members 45 so that the bolsters may be readily removed for ease of cleaning, maintenance, and interchangeability of bed types. Adjacent the foot of the bed where the bolster is widest, an interior passageway may be provided in the bolster 25 that is shaped to receive a vertical portion 45 of undercarriage 43. Such a passageway may be provided by a channel component 49 corresponding in shape to the portion 45, and rigidly attached to the interior rigid frame panel 50 of bolster 25. Adjacent the head of the bed where the bolster 25 is narrower in order to accommodate a rail assembly (to be further described) there may not be room for an interior passageway. Under such circumstances, an exterior channel component 49' may be provided which is rigidly attached to a board 51 mounted to the bolster 25, both board 51 and member 49' being covered by a cap 52 (see FIGS. 11 and 13).

The mounting means for the bolster (i.e. undercarriage 43) are constructed with respect to the mattress 24 so that each of the bolsters is spaced from a side of the mattress 24 a distance corresponding to about the width of an individual's hand, so that the mattress 24 may readily be properly covered with sheets and/or blankets, etcetera, with the bolsters 25 in place, yet the bolsters are not substantially spaced from the mattress. Cleaning of the interior bolster surfaces also is easy. The bolsters 25, located as illustrated in the drawings, also prevent roll out from the bed by providing a firm surface and tactile difference that signals to the user that the edge of the bed is being reached.

Where it is desirable to mount the headboard-wall panel to the bolster mounting means, hardware such as illustrated in FIG. 12 may be provided. Such hardware includes supporting tubes 54 that may be received by cutout portions in the upstanding flange of undercarriage member 44 at the head of the bolsters 25, and can be attached thereto wih screws or other fasteners. The tubes 54 are connected to the headboard-wall panel 14 utilizing brackets 55 which engage the panel edges much like the hangers 33, and strap 56 spaces the tubes 54 apart. Vertically adjustable floor glides comparable to components 48 may be provided on the bottoms of tubes 54 if desired.

In many situations, however, the headboard-wall panel 14 need not be directly connected to the undercarriage 43, but rather may be mounted with respect to, but unconnected to, the mattress 24 and bolster mounting means by the other wall panels 12 which are operatively attached thereto, including at least one wall panel 12 extending in a plane substantially perpendicular to the plane of the panel 14.

The Bed Rail Assemblies

Rail means are associated with the bolsters 25 for preventing one on mattress 24 from rolling off the mattress. However, unlike many conventional rail systems, the rail means are readily adjustable in length along the dimension of elongation of the bolsters 25 to provide a first position wherein bed ingress or egress is allowed while the rail means provides a support surface for assisting in the ingress or egress; and a second position wherein ingress and egress is substantially prevented and the roll-off function is maximized. Also, the rail means are movable to a completely inoperative position below the top of the bolsters 25. In the inoperative position the rail means is completely out of the way and provides no safety hazard or the like.

Figure 13:
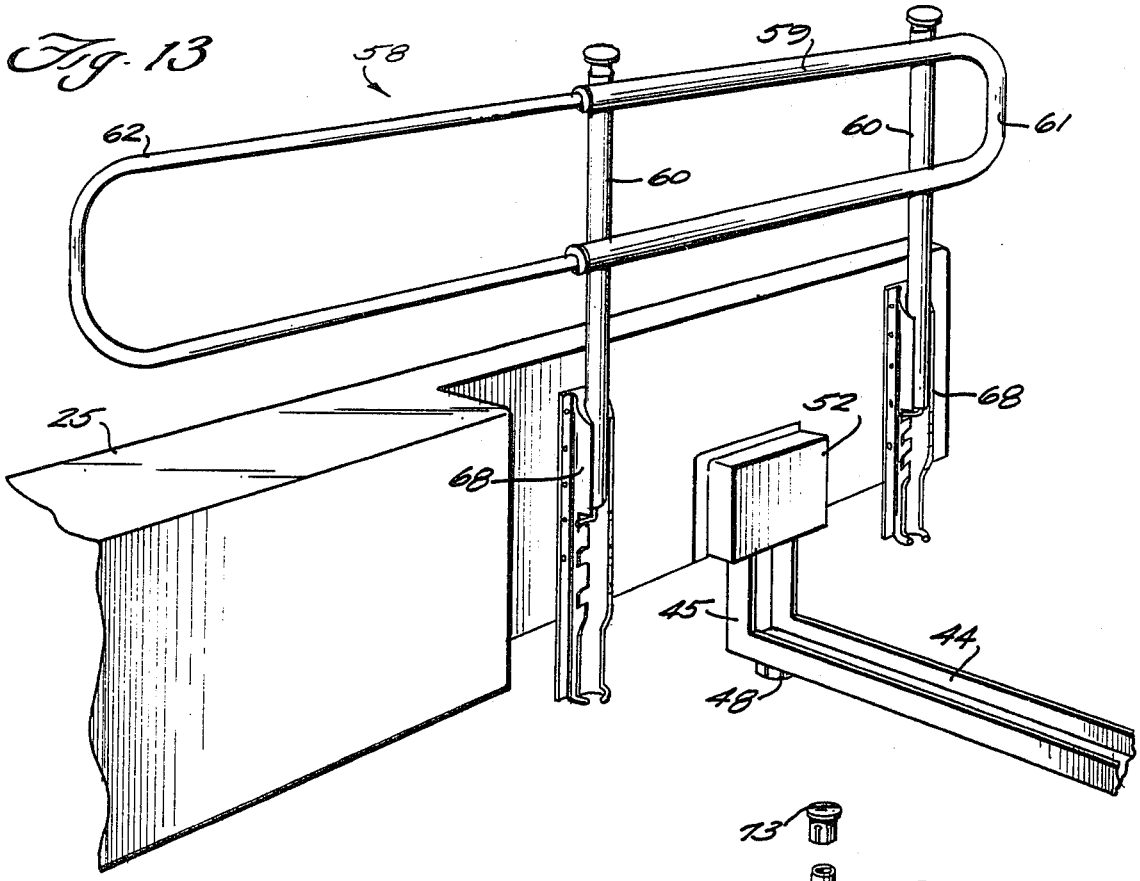
FIGS. 13 and 14 are perspective assembly and exploded views, respectively, of an exemplary rail assembly with the bolsters illustrated in FIG. 11.
Figure 14:
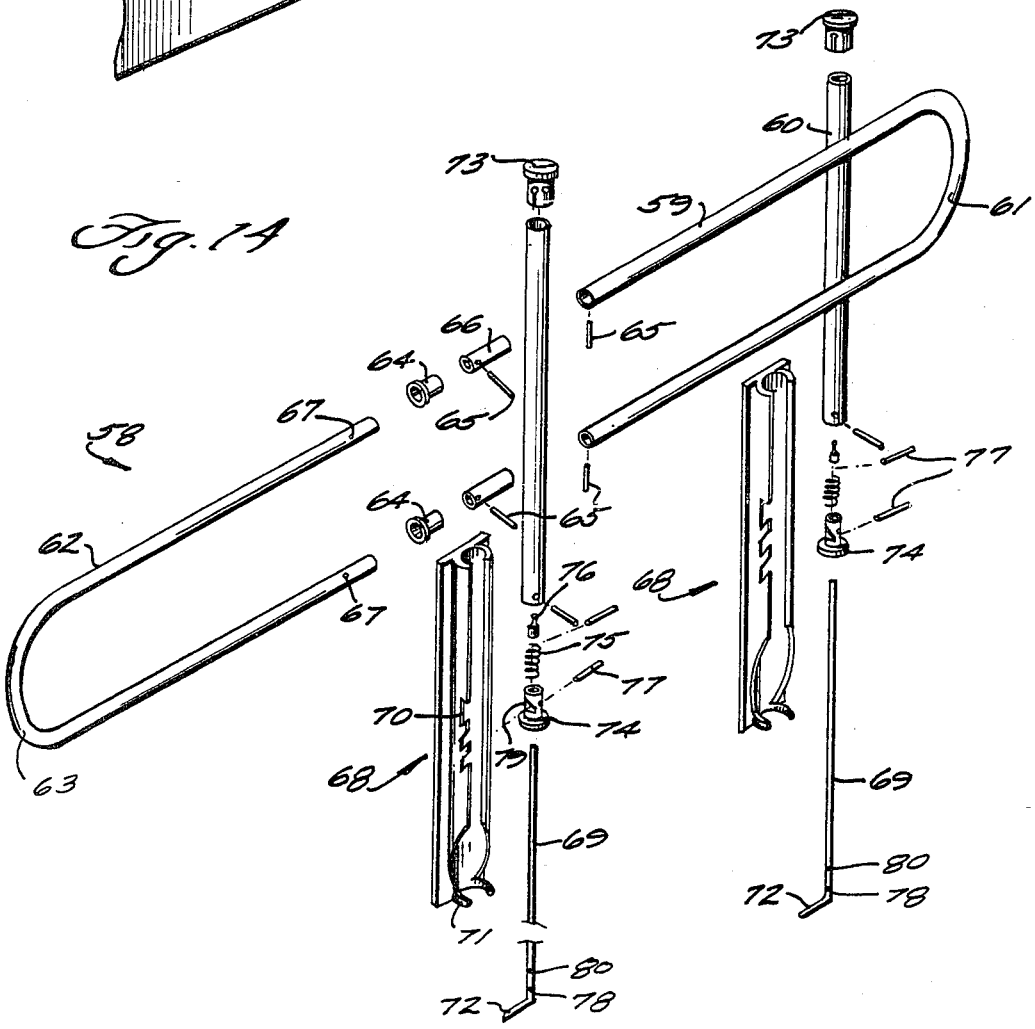

Exemplary rail means are indicated generally by reference numeral 58 in the drawings, and are illustrated most clearly in FIGS. 13 and 14. The rail means 58 include a first hollow tubular portion 59 rigidly attached to upstanding tubular supports 60. The tubular first portion 59 includes two vertically spaced portions, which preferably are interconnected by rounded connecting portion 61. A second portion 62 also is provided including a pair of vertically spaced portions interconnected by a rounded interconnecting portion 63. The second portion 62 has an outside diameter slightly less than the inside diameter of the tubular first portion 59 so as to be telescopically received thereby. In a first position, second portion 62 is essentially completely received within the first portion 59 (e.g. see FIG. 1) while in a second position it extends outwardly therefrom along the dimension of elongation of the bolster 25 with which it is associated (see FIG. 13).

In order to prevent the second portion 62 from being completely withdrawn from the first portion 59, a rail cap/stop 64 (see FIG. 14) is provided associated with each of the vertically spaced portions of member 59, and spring pins 65 are associated therewith and openings 66, 67 in members 59, and 62 respectively.

The vertical support tubes 60 are mounted to the bolster 25 in such a way that they are movable from a position supporting the rail member 59 above the top of the bolster 25 (FIG. 13), to a position below the top of the bolster 25 (see FIG. 1). The structure so mounting the tubes 60 is designed so that an operator moving the rail from one position to the other must use both hands and preferably must use an initial motion opposite of the direction of movement. Such contrary motions ensure a double measure of safety since a person not familiar with the operation would not understand how to do either.

The means mounting the vertical tube 60 include a pair of channels 68 rigidly attached to the head portion of the bolster 25 (as by screws). The channels 68 encompass more than a 180° arcuate portion of the tubes 50 to contain them therewithin. The tubes 60 are held in a position to which they have been vertically moved with respect to the channel 68 by the locking rods 69, which are adapted to cooperate with locking slots 70 and bottom surface 71 of channel 68.

The channel 68, while extending more than 180° around tube 60, extends substantially less than 360°, being open in the front to allow vertical movement of latching portion 72 of latching rod 69, and portions of rail member 59 below the top of bolster 25.

The latching portion 72 of each latching rod 69 is moved between positions received within slots 72 or by surface 71, and received by the open front of channel 68, utilizing push button cap 73, swivel cap 74, spring 75, latch rod assembly connector 76, and spring pins 77. One spring pin 77 extends through an opening 78 in latch rod 69 and through angled slot 79 in swivel cap 74, while another spring pin 77 extends through opening 80 in latch rod 79, with the spring 75 surrounding rod 69 and disposed between the pins 77. The top of latch rod 69 is knurled and receives latch rod assembly connector 76 thereon, the rounded head of the connector 76 being received by the latch button 73. Button 73 is constructed so that bottom portions thereof cam outwardly as the rounded head of connector 76 is brought into contact therewith, and then resiliently spring back to position abutting and maintaining the bottom of the rounded head of connector 76.

The components 73, 76, 74, and 68 all may be made of Delrin, Nylon, or like material, while the members 59, 60, and 62 preferably are metal (e.g. steel tubes with a mirror chrome finish). The latching rod 69 also is metal.

To lift the rail, one must push down on cap 73, which causes pins 77 engaging slots 79 to rotate latch portion 72 of latch rod 69 out of interfering engagement with latch portion 71, allowing the entire rail assembly to be moved upwardly until the latch member 72 engages a latching slot 70. Once in an extended position, the rail is moved downwardly by first lifting up on the cap actuator 73, again causing rotation of the latch portion 72 of latch rod 69 out of engagement with slots 70 so that the rail assembly may be moved downwardly.

Rail Clip

Figure 16:
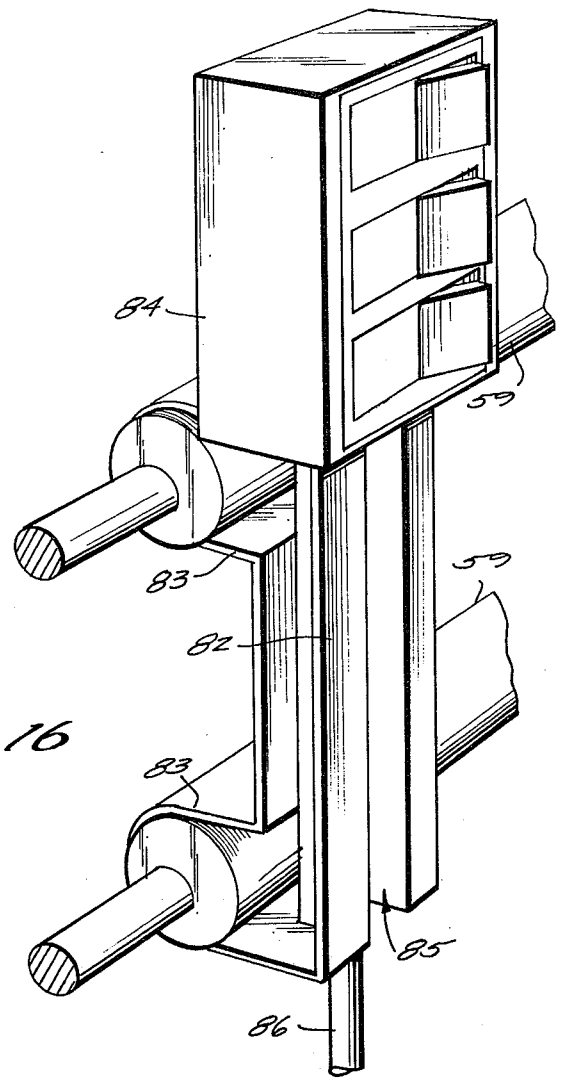
FIG. 16 is a detail perspective view of the clip means mounted on the rails of FIG. 15, supporting a control console.

In order to keep controls for the bed (which conventionally would be a hospital-type bed having the ability to articulate in various manners) accessible to the occupant, it is desirable to provide an assembly for mounting the bed electrical control console right on the rails. This is accomplished utilizing the clip means illustrated in FIGS. 15 and 16. The clip means comprises a main body portion 82 with a pair of clips 83 extending perpendicularly thereto, one at either end thereof, and each clip having surface means for receiving one of the vertically spaced rails. For instance, the clips 83 may have a portion thereof of the same curvature as the spaced components of rail member 59 so that they may be slid thereover, as clearly illustrated in FIG. 16. A support portion, such as the surface joining upper clip 83 and body portion 82, supports a conventional electrical console 84. A channel 85 is defined in the body portion 82 to allow passage of the electrical cord 86 from console 84 therethrough without disturbing the mounting of the console 84.

Of course a similar clip means may be utilized to mount a nurse call button, or electrical controls for other appliances in the room environment. Or a single electrical control console can be designed for bed functions and other appliance controls.

Figure 15:
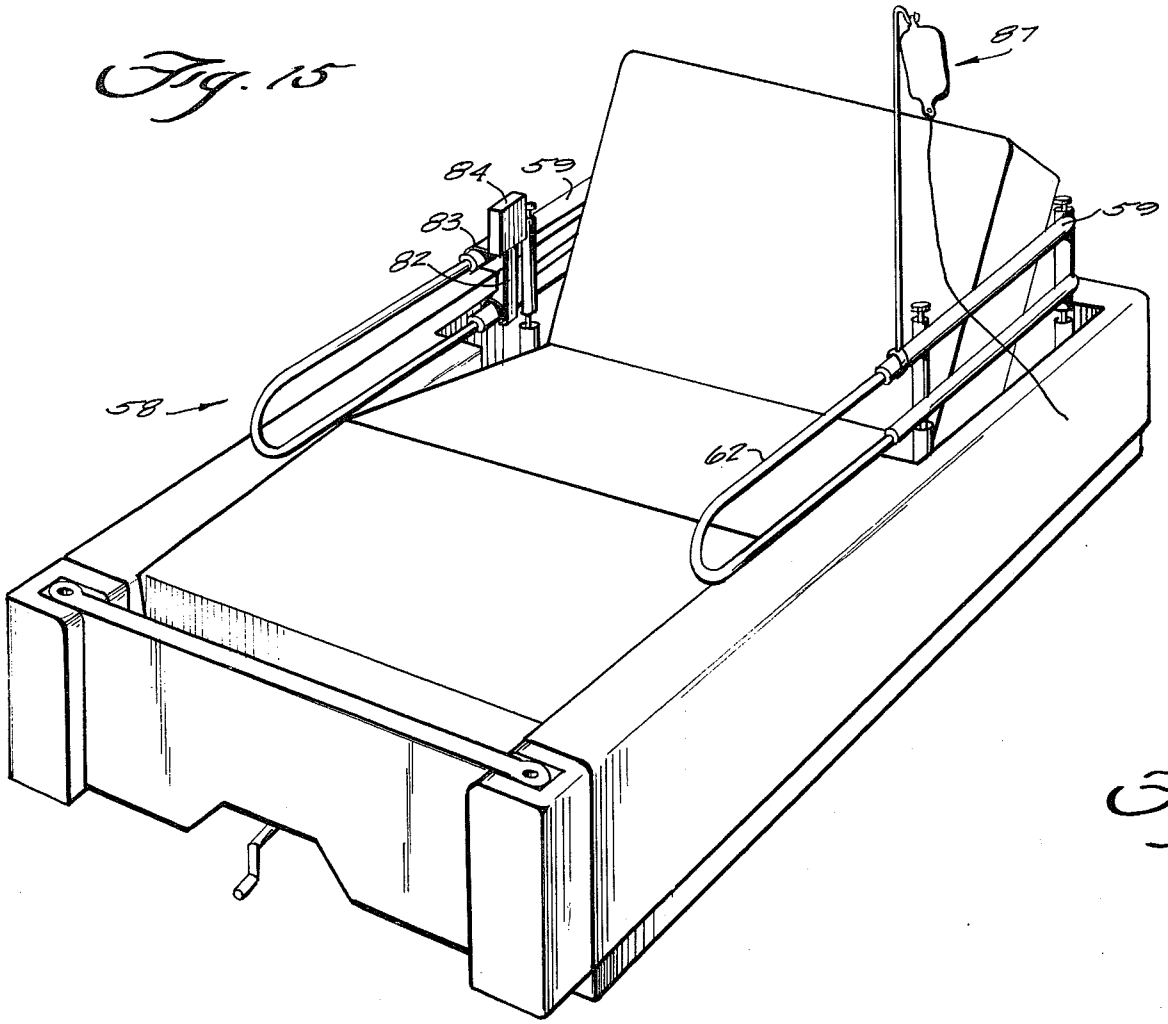
FIG. 15 is a perspective detail view of the bed assembly of FIG. 1 with rails in an up and extended position.

As illustrated in FIG. 15, the rails are also suitable for mounting various accessory medical components, such as the I.V. 87 (see FIG. 15).

Over Bed Tray

Figure 17:
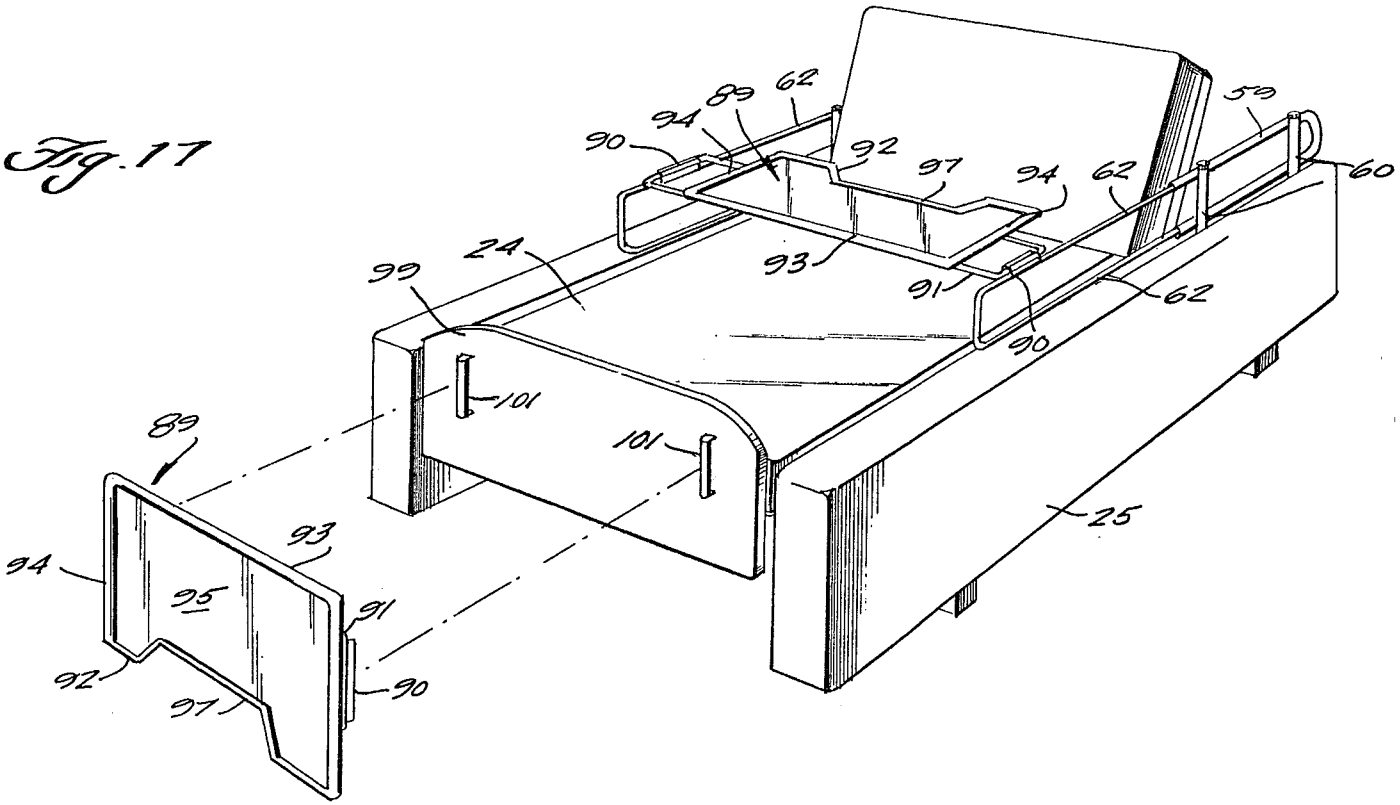
FIG. 17 is a perspective view of the bed assembly of FIG. 1 with a tray mountable either with the bed toeboard or the bolster rails.
Figure 18:
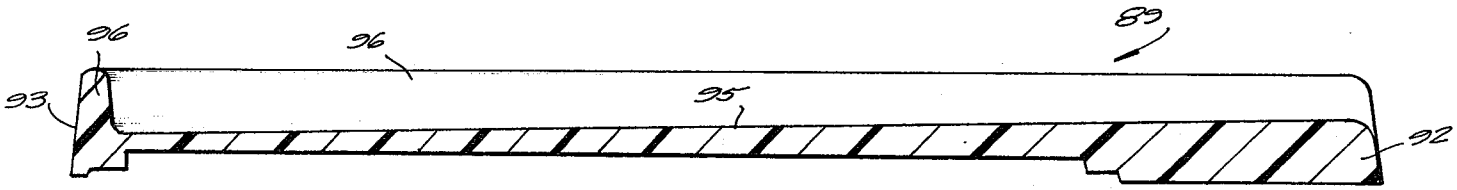
FIG. 18 is a cross-sectional view of the tray illustrated in FIG. 17.

An over bed tray is utilized in FIGS. 17 and 18, designed to be utilized with the rail assembly so that an individual sitting on mattress 24 may write or eat conveniently. The tray 89 has mounting clips 90 associated therewith which are adapted to receive the rail second portion 62, as illustrated in FIG. 17, to releasably mount the tray 89 on the rails. The clips 90 preferably are mounted on rods 91 that can telescope with respect to structures mounted on the bottom of tray 89 to move from the extended position illustrated at the top of FIG. 17 to the retracted position illustrated at the bottom of FIG. 17.

Preferably the tray is of plastic, such as self-skinning structural foam, and comprises a body having a head portion 92, a foot portion 93, and a pair of parallel sides 94. The tray 89 has a substantially flat support surface 95 that gently slopes downwardly (e.g. about 0.5°) from the head portion 92 to the foot portion 93. A vertical lip 96 upstands from the flat surface 95 along the foot portion 93 and along at least portions of the sides 94 adjacent the foot portion.

A cutout 97 is formed in the head portion 92 of the tray 89. The cutout 97 performs several functions. It allows an individual using the tray to position himself-/herself so that portions of the tray 89 are on either side of the individual's body. Additionally, the cutout allows conventional bed hardware (e.g. see crank 98 in FIG. 1) to extend outwardly therepast to be utilized in a normal manner when the tray is mounted in an inoperative position.

In order to provide for ready accessibility of the tray, while mounting it out of the way so that it does not interfere with normal activity in the room environment, it is highly desirable to mount the tray 89 on or adjacent the toeboard 99 (see FIG. 17) of the bed. In the embodiment illustrated in FIG. 1, an extension 100 of each bolster 25 is provided having a channel-shape to receive the tray 89 therein. However, it is preferable to provide rail segments 101 (having substantially the same diameter as the rail second portion 62) mounted directly to the toeboard 99 for receipt by the clips 90 to hold the tray in place on the toeboard.

If desired, the tray 89 also may be modified to have accessory or conjuctive structures for mounting it to the arms of a wheelchair or the like.

Fold-Down Desk

Figure 21:
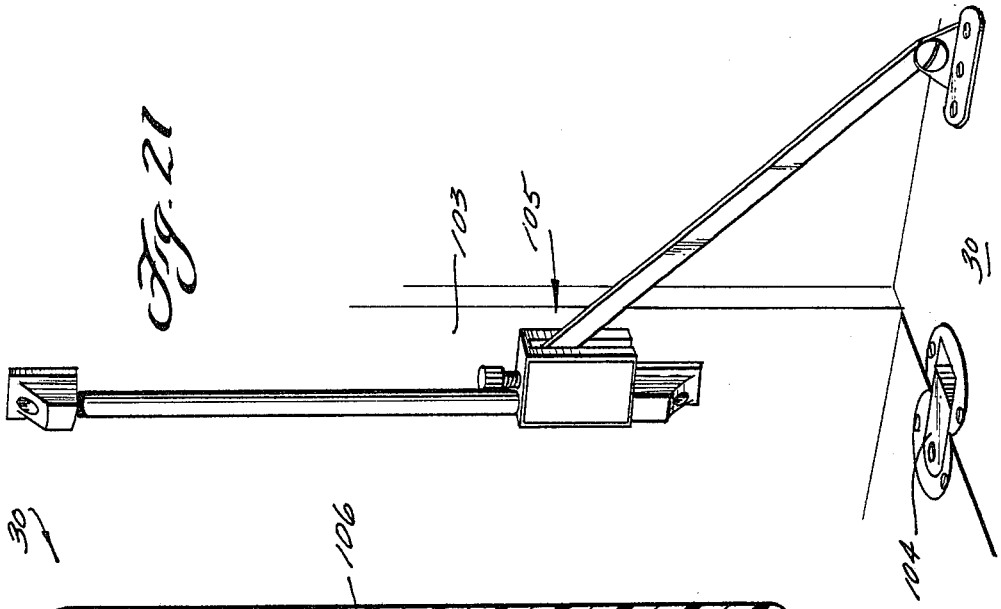
FIG. 21 is a perspective view of an exemplary flap brake utilizable with the desk writing surface of FIG. 19.
Figure 20:
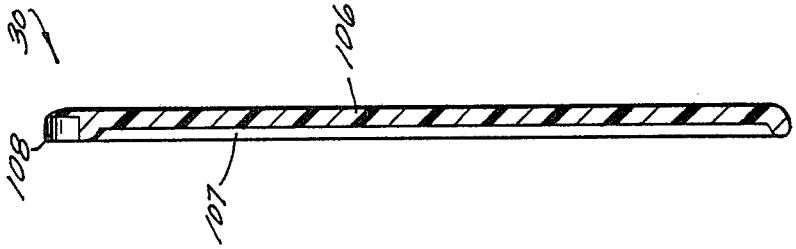
FIG. 20 is a cross-sectional view taken along lines 20—20 of FIG. 19.
Figure 19:
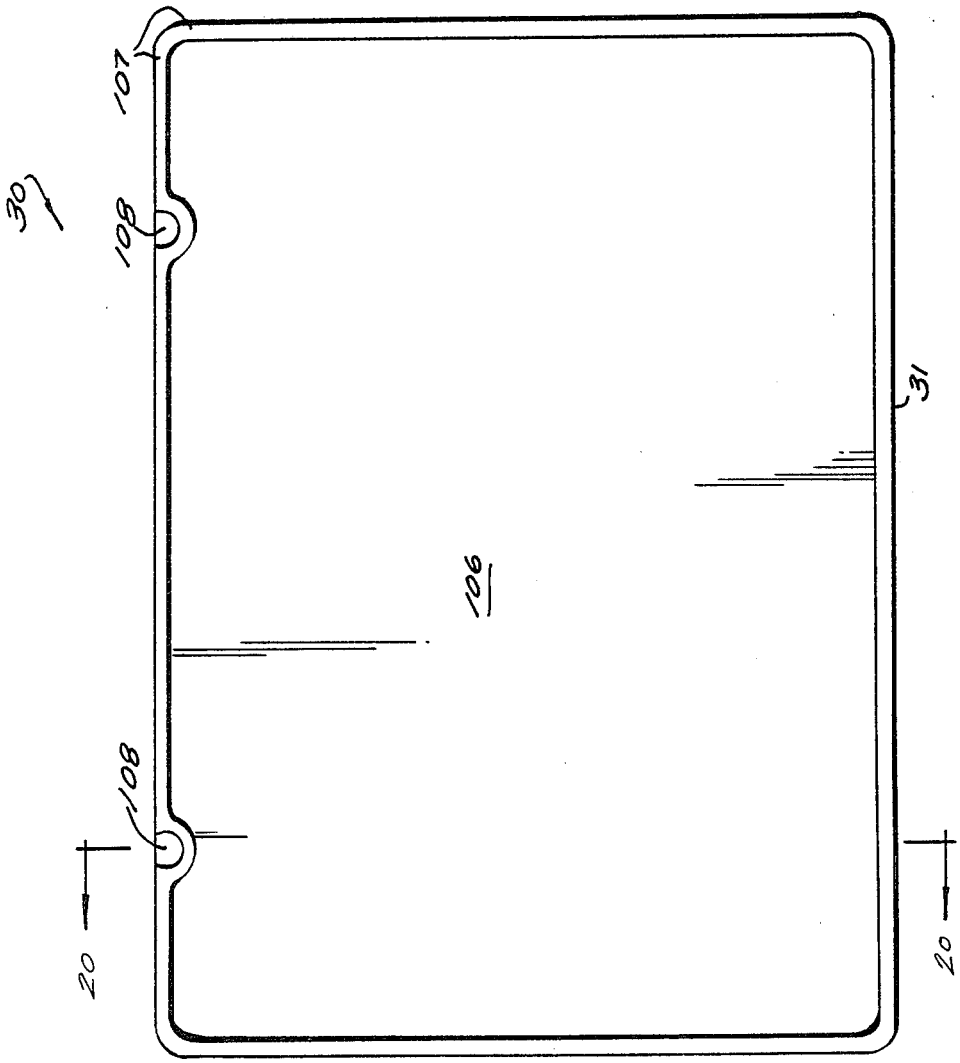
FIG. 19 is a top plan view of the writing surface of the fold-down desk illustrated in FIG. 1.
Figure 23:
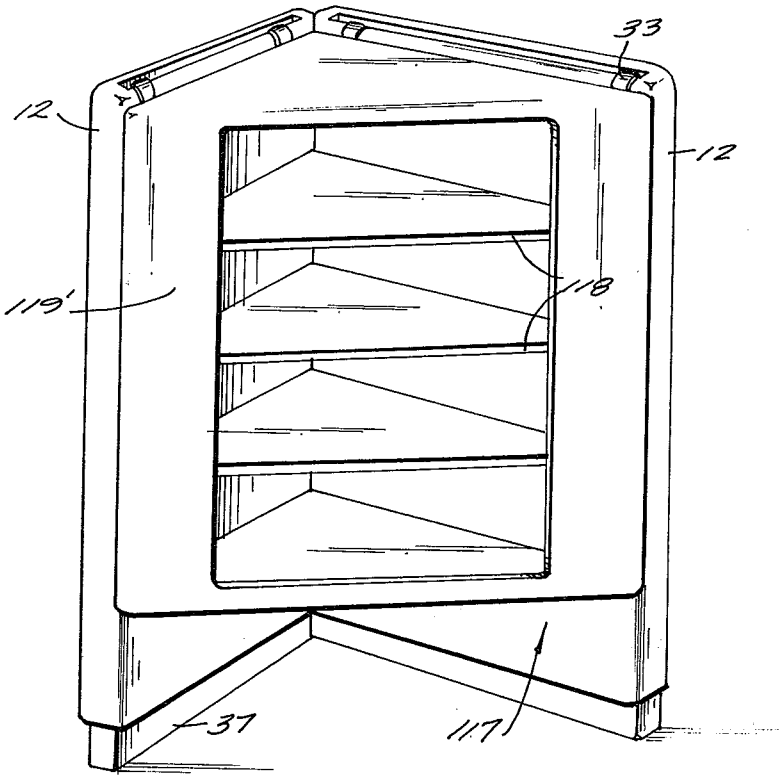
FIG. 23 is a perspective view of a shelfed article supporting unit that may be utilized in place of or in addition to the closet unit of FIG. 22.

A fold-down desk 16 preferably is provided in a room environment, being most desirably located mounted by hangers 34 on a panel 12 adjacent the bed assembly 10. With particular reference to FIGS. 1, 6, and 19 through 20, it will be seen that the fold-down desk 16 includes a casing 103, the writing surface 30, means—such as hinges 104 (see FIG. 21 in particular)—for pivotally mounting the writing surface 30 to the casing 103, and means for interconnecting the writing surface and the casing so that as the writing surface is moved away from the casing about the pivot means (hinges 104) the movement of the writing surface is slow and gradual until it is positively stopped at a predetermined position. Such interconnecting means preferably comprise a flap brake, illustrated generally at 105 in FIG. 21, provided on each side of the casing 103. Any conventional type of flap brake may be utilized, such as braking lid stay type K-54 manufactured by Wood Technology, Inc. of Midland Park, New Jersey, or Hafele flap brakes sold under the trademark "FALL-EX". A Wood Technology, Inc. braking lid stay type K-54 is illustrated in FIG. 21.

The hangers 34 mount the casing 103 to a wall panel 12 so that the writing surface 30 is movable from a first position where it is substantially vertical and abuts the casing 103 (it may be held in this position with a latch if desired), to a second, operative position wherein it is stopped with respect to the casing 103 and is substantially horizontal. The second position is illustrated in FIGS. 1 and 6.

The writing surface, which preferably is made of plastic, comprises a flat body 106 (see FIGS. 19 and 20 in particular) with a raised edge 107 around substantially the entire circumference thereof. Flattened portions 108 are provided along one edge of the tray 30 for receipt of the hinges 104.

The casing 103 includes means defining an elongated recess 109 (see FIG. 1) along at least one side of the periphery of casing 103. The recess 109 is defined so that when the writing surface 30 is substantially vertical and abuts the casing 103 the writing surface may be readily pivoted downwardly by an individual merely putting their palm, or other portion, of their hand between the writing surface 30 and the casing 103 at the recess 109. This is especially important for arthritic users.

If desired, a light source may be disposed within the casing 103 and means may be provided for automatically actuating the light source to turn it on when the writing surface is moved to the substantially horizontal position thereof.

Storage Units

Figure 22:
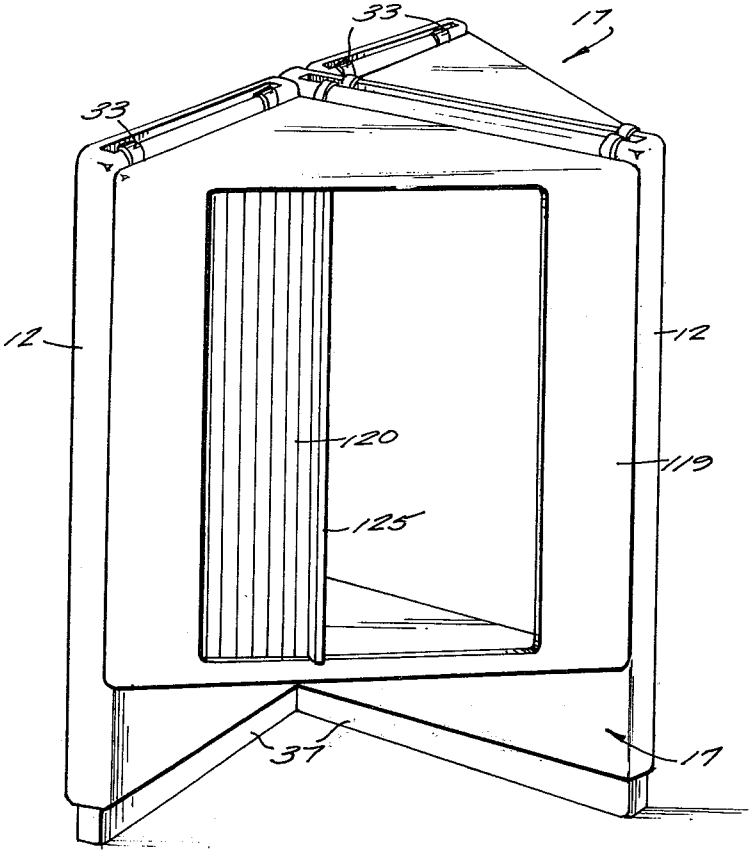
FIG. 22 is a perspective view of an exemplary clothes supporting unit utilizable in a personalized environmental setting according to the invention.

A personalized environment according to the present invention preferably will utilize vertical storage modules, such as module 17, as illustrated in FIGS. 1 and 22 through 25. The storage module 17 is adapted especially for storage of personal belongings which need to be hung vertically, such as bathrobes, dresses, shirts, and other clothing, with the bottom thereof also providing a storage area for slippers, etcetera. Another version of storage module is illustrated at 117 in FIG. 23, and instead of providing for hanging of clothing, has a plurality of shelves 118 or the like for supporting various articles. Both types of storage modules 17, 117 are mounted in a corner at the intersection between two panels 12 so that it will not interfere with movements of wheelchairs, walkers, portable emergency equipment, or the like in the room environment. Where a series of panels 12 provide a common division for two room environments, it may be desirable to mount storage unit 17 as illustrated in FIG. 22.

The storage units 17, 117 have a polygon shape in cross-section, and include a front wall 119, 119' respectively having an access opening defined therein. Structure 17 includes a tambour door 120 for selectively blocking or unblocking the access opening, and a pair of rail structures (e.g. rails 121 in FIG. 24) are provided at the top and bottom of the unit 17 for mounting the tambour door. With the hangers 33 mounting the unit 17 on the wall panels 12, the rail structures 121 are in horizontal planes vertically spaced from each other. The rail structures 121 have at least two turns 122, 123 therein, of at least about 90°.

As with all accessory components, the storage units 17, 117 are so dimensioned and the hangers 33 are so provided that the storage structures are spaced from the ground along the entire extent thereof a distance D corresponding to at least the height of a toeboard 20 of a wheelchair 21 off the ground. Preferably the storage structures 17, 117 comprise right triangular prisms, with the wall defining the hypothenus of the right triangular prism having the access opening formed therein.

A handle 125 (see FIGS. 22 and 25 in particular) is provided on the tambour door 120 extending the full length thereof so that the door may be moved by engaging it at any location along the height of the storage module. The handle 125 may be readily pulled or pushed, and because of the right-angular shape thereof it acts as a stop for door movement in either direction. The units 17, 117 are also relatively shallow which allows a nonambulatory person in a wheelchair to reach the contents thereof without leaving the wheelchair.

An exploded view of an exemplary structure 17 is illustrated in FIG. 25, having side walls 127, 128, bottom 129, top 130, and front wall 119 with the access opening formed therein. The various components are connected together in any desirable manner, such as with angle members 131, 132 and suitable fasteners, glue, or the like.

Utilizing some or all of the components described above, it will be apparent that interior space room divisions for a nursing home may be readily provided that result in safety, comfort, control, and a sense of personal ownership for the aging people occupying the nursing home. All components are specifically devised with the particular needs of a nursing home resident in mind, and provide satisfaction of those needs.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies, furniture groupings, and methods.

What is claimed is:

1. A bed assembly comprising: a mattress; a frame supporting said mattress; a pair of flat-topped bolsters elongated in parallel directions of elongation; bolster mounting means distinct from said mattress frame for readily removably mounting said bolsters so that one is readily removably disposed on either side of said mattress, covering substantially the entire height and length of the mattress and mattress frame, and exterior of and distinct from said mattress frame; each bolster being formed of material of sufficient hardness so that a person may sit thereon without significantly deforming the same to facilitate in-bed and out-of-bed transfers, each bolster providing more support than a mattress edge, yet each bolster being soft enough so that a person falling so as to impact a side of the bed will impact a bolster and will have their fall cushioned by the bolster so as to minimize the chance of injury; and said bolster mounting means comprising means for mounting said bolsters with respect to said mattress so that the flat top surface of each of said bolsters may be substantially even with the top of said mattress and so that a person impacting the bed assembly along the sides will impact a bolster.

2. A bed assembly as recited in claim 1 wherein each of said bolsters comprises a bolster frame of relatively rigid material, and covering means of relatively softer material.

3. A bed assembly as recited in claim 2 wherein said relatively softer material comprises foam covered with sheet material.

4. A bed assembly as recited in claim 3 wherein said sheet material comprises vinyl.

5. A bed assembly as recited in claim 3 wherein each of said bolsters foam has a minimum density of about 6 lbs/ft.$^3$, and a minimum resiliency of about 35%.

6. A bed assembly as recited in claim 1, 3, or 5 wherein said bolster has a height generally corresponding to the height of a wheelchair.

7. A bed assembly as recited in claim 1 further comprising a mattress supporting frame including a plurality of legs for supporting the mattress off a floor, and wherein said bolster mounting means and said bolsters are so constructed with respect to said mattress that each of said bolsters is horizontally stationarily mounted so that it is spaced from a side of the mattress about the width of an individual's hand so that the mattress may readily be properly covered with sheets and/or blankets with the bolsters in place, yet the bolsters are not substantially spaced from the mattress.

8. A bed assembly as recited in claim 1 further comprising rail means associated with each of said bolsters extending above said bolsters and extending parallel to the direction of elongation of said bolsters for preventing one on said mattress from rolling off said mattress.

9. A bed assembly as recited in claim 1 further comprising a headboard-wall panel having a light mounted thereon, and means for mounting said headboard-wall panel to said bolster mounting means so that said panel forms a headboard of said bed assembly and said light is mounted well above said mattress to shine light on at least areas of said mattress adjacent said headboard-wall panel.

10. A bed assembly as recited in claim 9 wherein said light comprises a linear light source covering substantially the entire width of said headboard-wall panel, said light being releasably attached to said headboard-wall panel.

11. A bed assembly as recited in claim 1 further comprising a headboard-wall panel; means for operatively mounting said headboard-wall panel with respect to, but unconnected to, said mattress and said bolster mounting means; and a linear light source operatively associated with said headboard-wall panel mounted well above said mattress to shine light on at least areas of said mattress adjacent said headboard-panel.

12. A bed assembly as recited in claim 11 wherein said means for operatively mounting said headboard-wall panel with respect to said mattress comprises a plurality of other wall panels, each floor supported and operatively attached to said headboard-wall panel, but distinct from and spaced from said mattress and bolsters and bolster mounting means, including at least one wall panel extending in a plane substantially perpendicular to the plane of said headboard-wall panel.

13. A bed assembly as recited in claim 12 further comprising light means located in the top of at least one of said wall panels to shine light upwardly therefrom.

14. A bed assembly as recited in claim 12 wherein the height of said headboard-wall panel and said at least one other wall panel is greater than about 5 feet.

15. A bed assembly for use in a building having permanent walls and a floor and comprising: a mattress; a mattress supporting frame supporting the mattress and including a plurality of legs for supporting the mattress off the floor; a pair of bolsters, elongated in parallel directions of elongation, one disposed on either side of said mattress; means for mounting said bolsters so that they are readily removably disposed along the sides of said mattress, exterior of and distinct from said mattress supporting frame; a headboard panel, distinct from the building permanent walls, and having a light mounted thereon; and means for mounting said headboard panel to said bolster mounting means so that said panel forms the headboard of said bed assembly but is separate and distinct from said mattress supporting frame, and said light is mounted well above said mattress to shine light on at least areas of said mattress adjacent said headboard panel; said bolster and headboard mounting means comprising means for allowing access to said mattress frame for removal from between said bolsters in a direction opposite said headboard and parallel to the directions of elongation of said bolsters, said bolsters and headboard restricting removal in other directions.

* * * * *